US009111700B2

(12) United States Patent
Liu et al.

(10) Patent No.: US 9,111,700 B2
(45) Date of Patent: Aug. 18, 2015

(54) THIN PUSH BUTTON STRUCTURE

(71) Applicant: ICHIA TECHNOLOGIES, INC., Taoyuan County (TW)

(72) Inventors: Chang-Li Liu, Taoyuan County (TW); Yu-Chih Chang, Taoyuan County (TW)

(73) Assignee: ICHIA TECHNOLOGIES, INC., Taoyuan County (TW)

( * ) Notice: Subject to any disclaimer, the term of this patent is extended or adjusted under 35 U.S.C. 154(b) by 103 days.

(21) Appl. No.: 14/099,193

(22) Filed: Dec. 6, 2013

(65) Prior Publication Data

US 2015/0136572 A1 May 21, 2015

(30) Foreign Application Priority Data

Oct. 18, 2013 (TW) ..... 102219446 U

(51) Int. Cl.

| | |
|---|---|
| ***H01H 13/14*** | (2006.01) |
| ***H01H 13/70*** | (2006.01) |
| ***H01H 13/10*** | (2006.01) |
| ***H01H 13/04*** | (2006.01) |
| ***H01H 13/06*** | (2006.01) |

(52) U.S. Cl.

CPC ..... *H01H 13/10* (2013.01); *H01H 13/04* (2013.01); *H01H 13/06* (2013.01); *H01H 2223/002* (2013.01); *H01H 2227/036* (2013.01); *H01H 2237/006* (2013.01)

(58) Field of Classification Search

CPC ..... H01H 3/125; H01H 3/14; H01H 3/70
USPC ..... 200/341–345
See application file for complete search history.

(56) References Cited

U.S. PATENT DOCUMENTS

| | | | | |
|---|---|---|---|---|
| 6,031,196 | A * | 2/2000 | Johnston | 200/343 |
| 7,005,588 | B2 * | 2/2006 | Pihlaja | 200/5 A |
| 7,161,106 | B2 * | 1/2007 | Kohatsu et al. | 200/511 |
| 8,791,378 | B2 * | 7/2014 | Lan | 200/5 A |
| 9,024,217 | B2 * | 5/2015 | Khor | 200/341 |
| 2009/0242368 | A1 * | 10/2009 | Chang et al. | 200/310 |
| 2012/0039026 | A1 * | 2/2012 | Dai | 361/679.01 |
| 2012/0055772 | A1 * | 3/2012 | Lin | 200/344 |
| 2012/0067711 | A1 * | 3/2012 | Yang | 200/341 |
| 2013/0334021 | A1 * | 12/2013 | Lan | 200/5 A |
| 2015/0014140 | A1 * | 1/2015 | Liu | 200/517 |

* cited by examiner

*Primary Examiner* — Renee S Luebke
*Assistant Examiner* — Ahmed Saeed
(74) *Attorney, Agent, or Firm* — Li&Cai Intellectual Property (USA) Office

(57) ABSTRACT

A thin push button structure includes a main board, a circuit board, an elastic element, a supporting plate, a key top and a frame. The circuit board is disposed on the main board and formed with a plurality of cavities. The supporting plate includes a seat, an extending portion and a contacting portion. The seat is formed with a window at the central region and connected to the contacting portion by the extending portion. The elastic element is disposed on the circuit board. The key top includes a main body and a plurality of posts that extend therefrom. The frame includes a through opening and a plurality of alignment grooves at the periphery of the opening. The frame sleeves the key top, and the posts are received by the alignment grooves. The key top caps the contacting portion and is movable within the alignment grooves and the cavities.

10 Claims, 19 Drawing Sheets

THIN PUSH BUTTON STRUCTURE

BACKGROUND

1. Field of the Invention

The instant disclosure relates to a push button structure, in particular, to a thin push button switch.

2. Description of Related Art

Push button structure is a common input device. The push button is widely used in different electronic products, for example, mobile phone, iPad and remote control. As electronic devices become thinner, the push button structure has to reduce its thickness as well. However, some issues remained to be solved before achieving even thinner push button structure.

For example, a conventional push button structure includes a key, a movable layer and a circuit board. The movable layer is disposed underneath the key and on top of the circuit board. The movable layer has flexible plates disposed at a position corresponding to the key. When the key is pressed, the flexible plate is pressed, and the central region of the flexible plate forms a dimple. Then a contact point on the circuit board is touched to make conduction between the movable layer and the circuit board. Therefore, a signal is generated and transmitted whenever the key is pressed.

However, when the key presses on the flexible plate, the movement path or the depression distance may vary, such that the contact point between the key and the flexible plate is different each time. More specifically, when a user does not presses the central region of the key, the key contacts an offset region of the flexible plate, and the flexible plate is very likely to shift resulting in conduction failure between the flexible plate and the circuit board.

To address the above issues, the inventor strives via associated experience and research to present the instant disclosure, which can effectively improve the limitation described above.

BRIEF SUMMARY OF THE INVENTION

The instant disclosure provides a thin push button structure to reduce the thickness of the key. In addition, if the key is not pressed at a central region, the corresponding signal can still be faithfully generated.

According to one exemplary embodiment of the instant disclosure, the thin push button structure includes a main board, a circuit board, an elastic element, a supporting plate, a key top and a frame. The circuit board is disposed on the main board and is formed with a plurality of cavities. The supporting plate includes a seat, an extending portion and a contacting portion. The seat is formed with a window at the central region, and the seat and the contacting portion are at different levels connected by the extending portion. The extending portion extends from one side of the seat and meets one side of the contacting portion. The elastic element is disposed on the circuit board and underneath the contacting portion of the supporting plate. The key top includes a main body and a plurality of posts. The key top defines a receiving space, and the posts extend from the main body. The frame includes a through opening and a plurality of alignment grooves at the periphery of the opening. The frame sleeves the key top, and the posts are received by the alignment grooves. The key top caps the contacting portion of the supporting plate and is supported thereby. Furthermore, the key top is movable within a compartment defined by the alignment grooves of the frame and the cavities of the circuit board.

It should be noticed that the supporting plate includes the extending portion which slantingly extends to connect the contacting portion and the seat. The supporting plate holds and aligns the key top in place. After the key top is pressed, the supporting plate provides a return force, such that the key top can flip back to its original position. In this regard, the key top supporting and alignment can be achieved with minimized thickness.

In addition, the key top has posts protruding outwardly from the main body. When the key top is not pressed at the central region, the post, which is closest to the pressed region, become a fulcrum, and the key top pivots. Accordingly, the key top tilts and abuts the elastic element. In this regard, no matter where the key top is pressed, the signal can be generated faithfully. Furthermore, the instant disclosure includes a supplemental element which ensures the signal generation when the pressure does not come from the central region.

In order to further understand the instant disclosure, the following embodiments are provided along with illustrations to facilitate the appreciation of the instant disclosure; however, the appended drawings are merely provided for reference and illustration, without any intention to be used for limiting the scope of the instant disclosure.

DETAILED DESCRIPTION OF THE INVENTION

The aforementioned illustrations and following detailed descriptions are exemplary for the purpose of further explaining the scope of the instant disclosure. Other objectives and advantages related to the instant disclosure will be illustrated in the subsequent descriptions and appended drawings. It should be noticed that only a single button is described for exemplary purpose. In practice, the switch can be an integral device with more than one buttons.

First Embodiment

Figure 1:
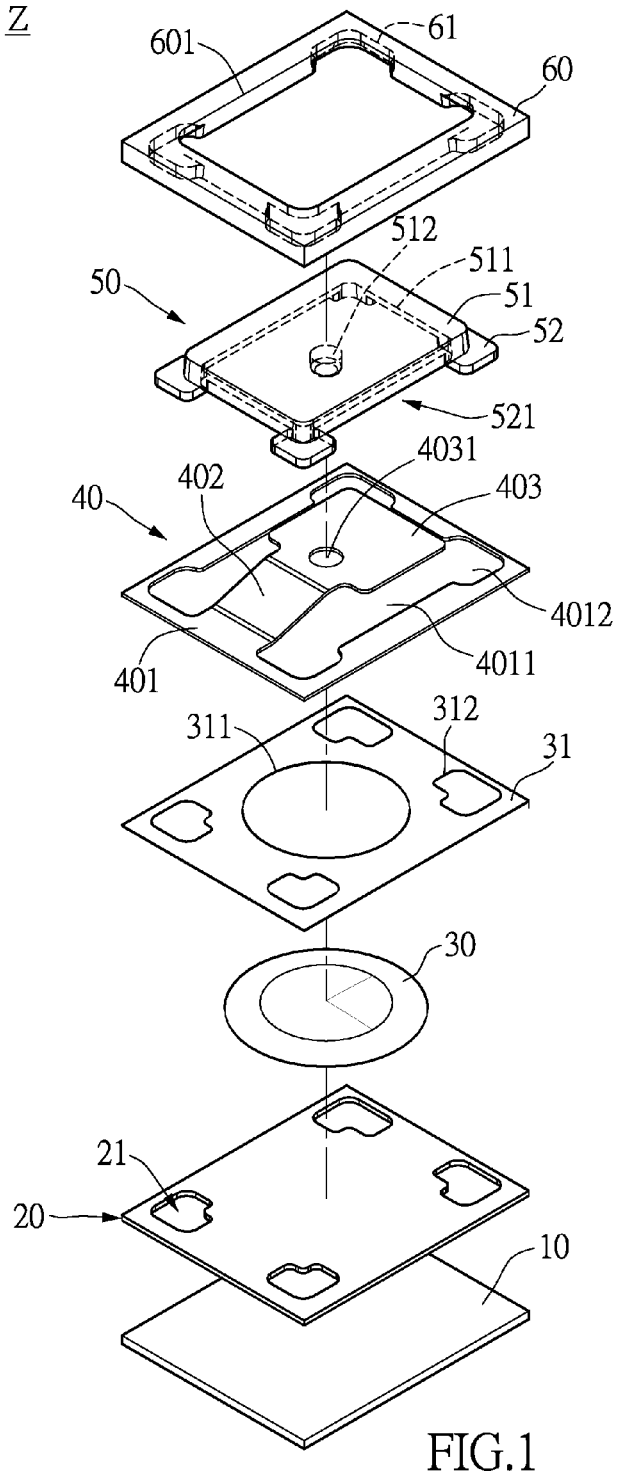
FIG. 1 is an exploded view of a thin push button structure in accordance with a first embodiment of the instant disclosure.
Figure 7:
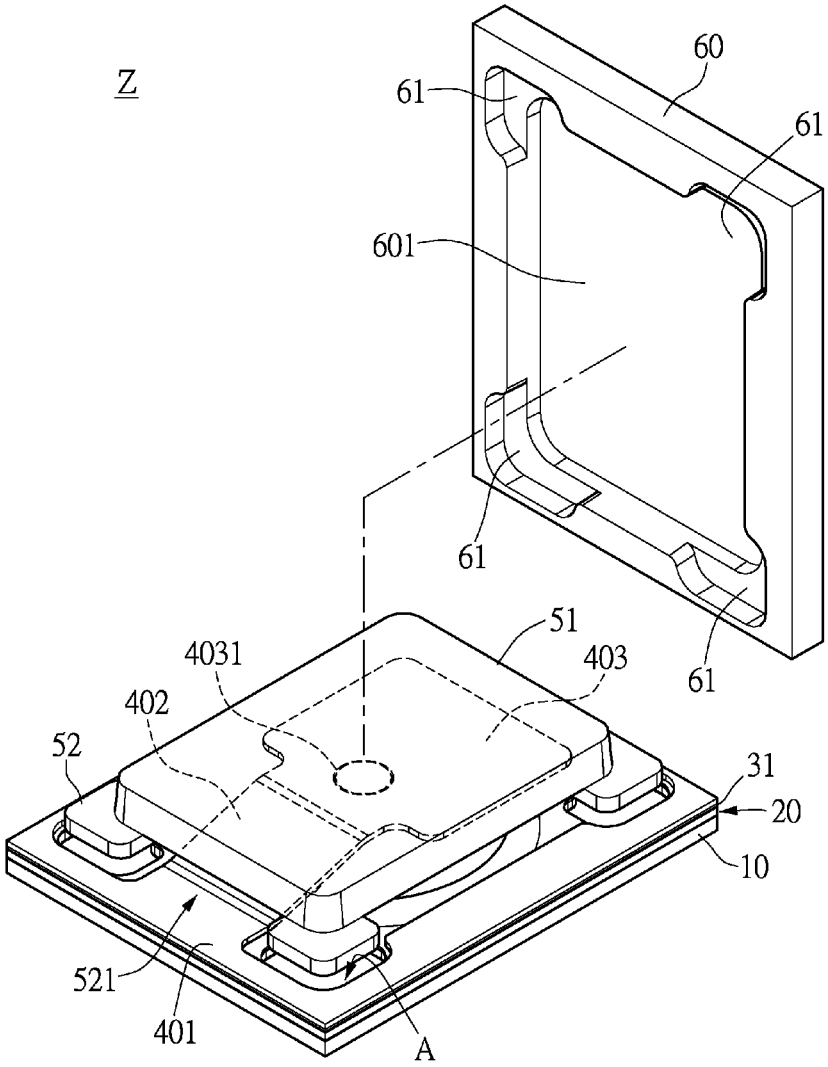
FIG. 7 is a diagram showing a frame of a thin push button structure in accordance with a first embodiment of the instant disclosure.
Figure 8:
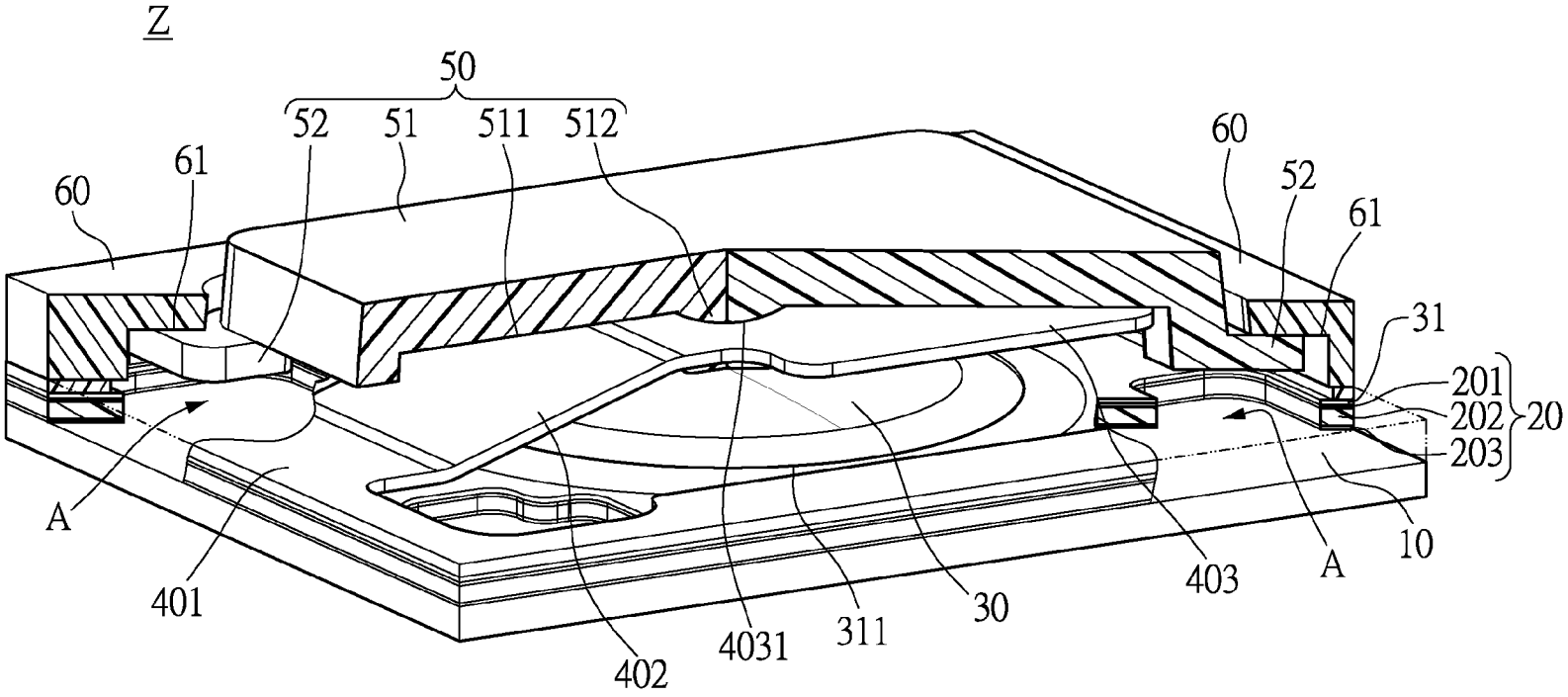
FIG. 8 is another diagram showing a frame of a thin push button structure in accordance with a first embodiment of the instant disclosure.
Figure 9:
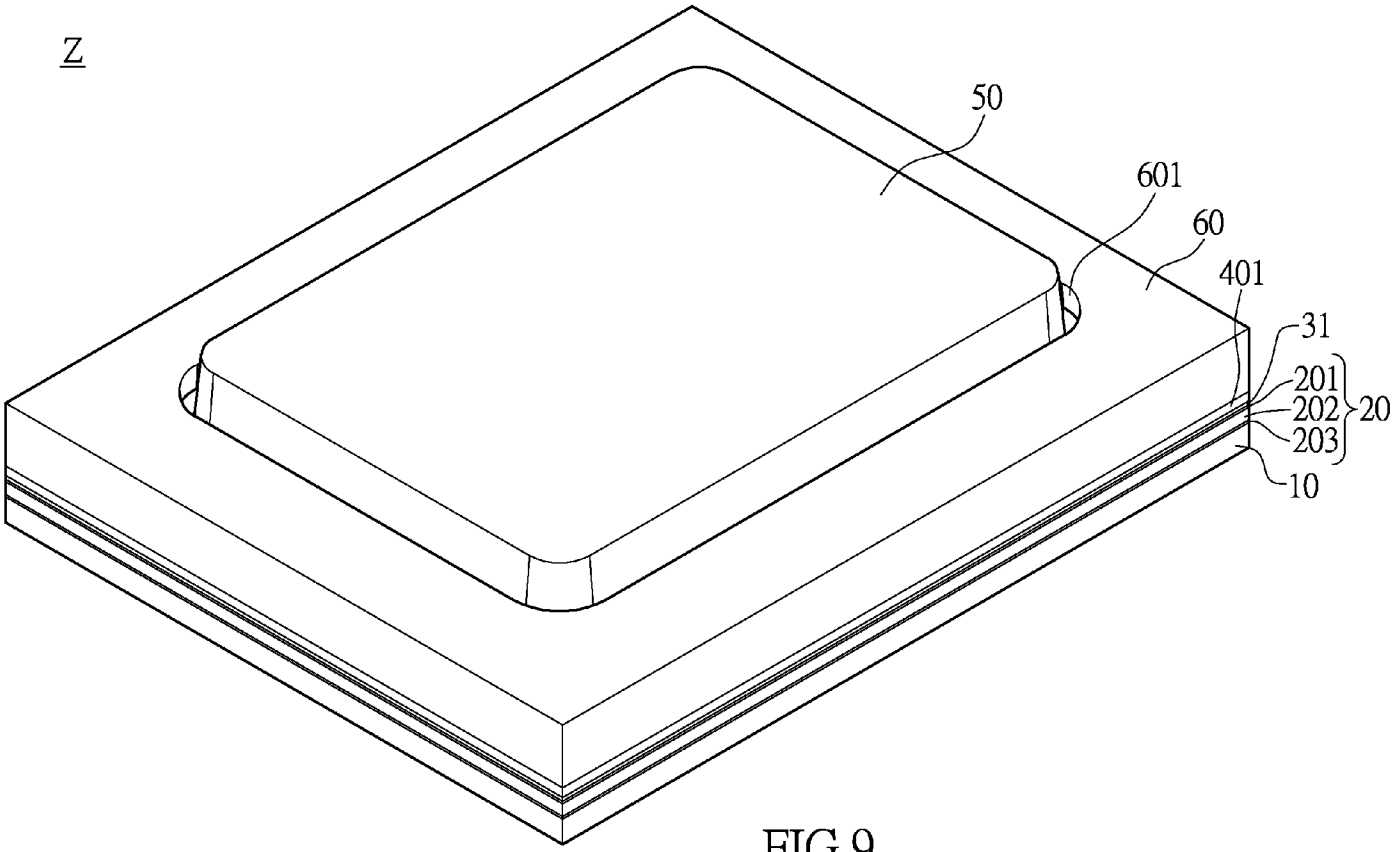
FIG. 9 is a diagram showing a thin push button structure in accordance with a first embodiment of the instant disclosure.

Please refer to FIGS. 1 to 9. FIG. 1 is an exploded view of a thin push button structure in accordance with the instant disclosure. FIGS. 2 to 8 are diagrams showing elements of the thin push button structure. FIG. 9 is a diagram showing the thin push button structure. As shown in FIG. 1, the thin push button structure includes a main board 10, a circuit board 20, an elastic element (a movable contact) 30, a supporting plate 40, a key top 50 and a frame 60. The circuit board 20, elastic element 30, supporting plate 40, key top 50 and frame 60 are disposed in succession on the main board 10. Preferably, the main board 10 is made of aluminum. The circuit board 20 may be a circuit membrane, flexible printed circuit (FPC) or flexible flat cable (FFC). The elastic element 30 may be a metal dome. The supporting plate 40 may be made of hard yet deformable membrane. The supporting plate 40 may be made of, for example, polycarbonate (PC), polyethylene terephthalate (PET), thermoplastic polyurethanes (TPU) or the like. The key top 50, which has a main body 51 and a plurality of posts 52, and the frame 60 may be made of harder plastic material. However, the materials may vary according to practical needs.

Figure 2:
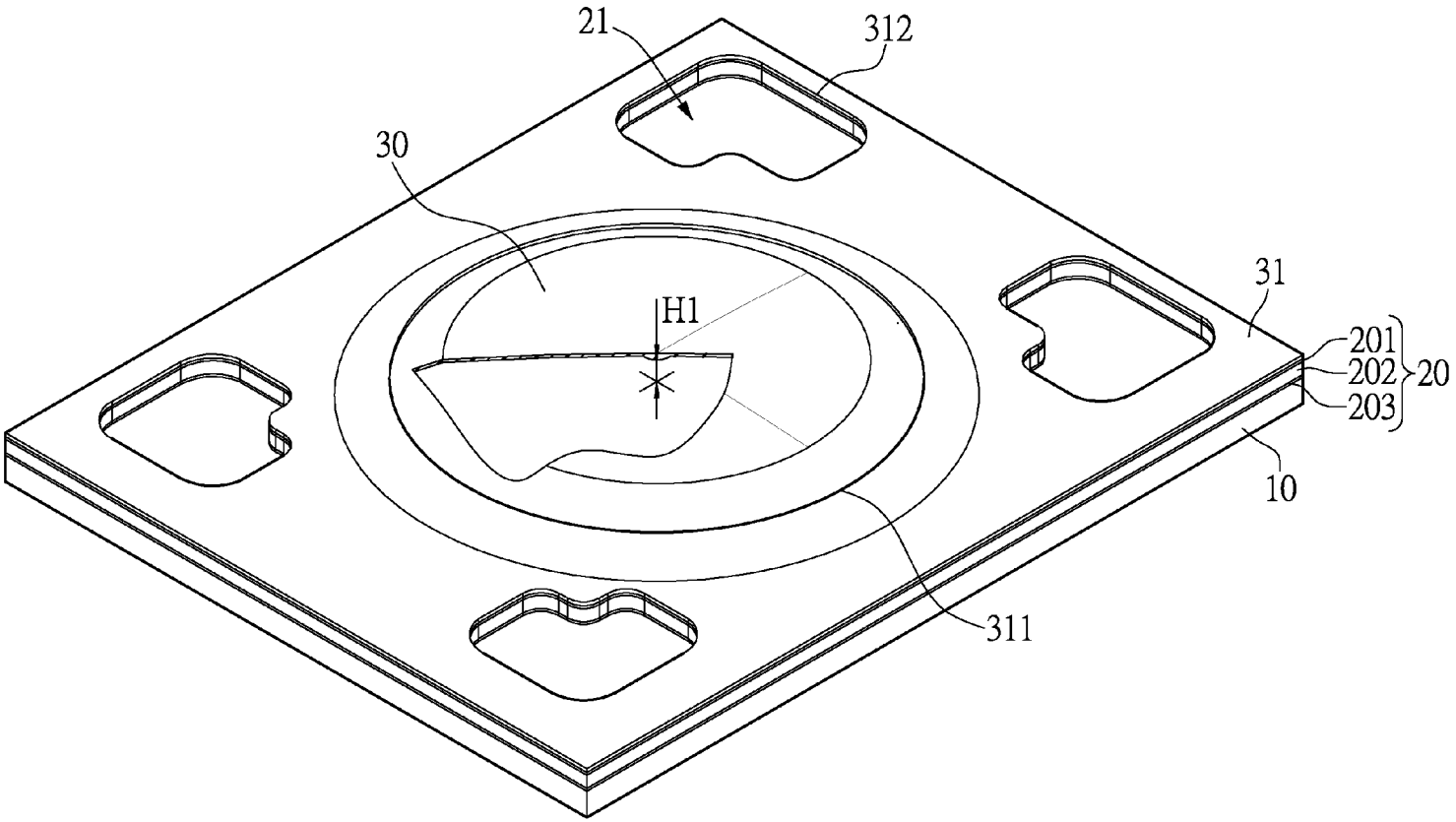
FIG. 2 is a diagram showing a circuit board and an elastic element of a thin push button structure in accordance with a first embodiment of the instant disclosure.

The arrangement of the abovementioned elements will be elaborated hereinafter. As shown in FIGS. 1 and 2, the circuit board 20 is disposed on the main board 10. The elastic element 30 is disposed on the circuit board 20. Preferably, an alignment plate 31 is disposed on the circuit board 20. The alignment plate 31 is formed with a through hole 311 for receiving the elastic element 30. The alignment plate 31 secures the elastic element 30 is on the circuit board 20. In other words, the elastic element 30 is sandwiched between the alignment plate 31 and the circuit board 20. The circuit board 20 has a plurality of cavities 21 (preferably four cavities) around the corners. In the instant embodiment the cavities 21 go through the circuit board 20; however, the instant disclosure is not limited thereto. For example, the cavities 21 may be depressed without going through the circuit board 20. The elastic element 30 resembles a dome with a bump in the central region. Because of the dome configuration, a distance H1 is created between the circuit board 20 and the apex of the elastic element 30. The alignment plate 31 is formed with a first post hole 312 corresponding to each of the cavities 21 of the circuit board 20.

Figure 3:
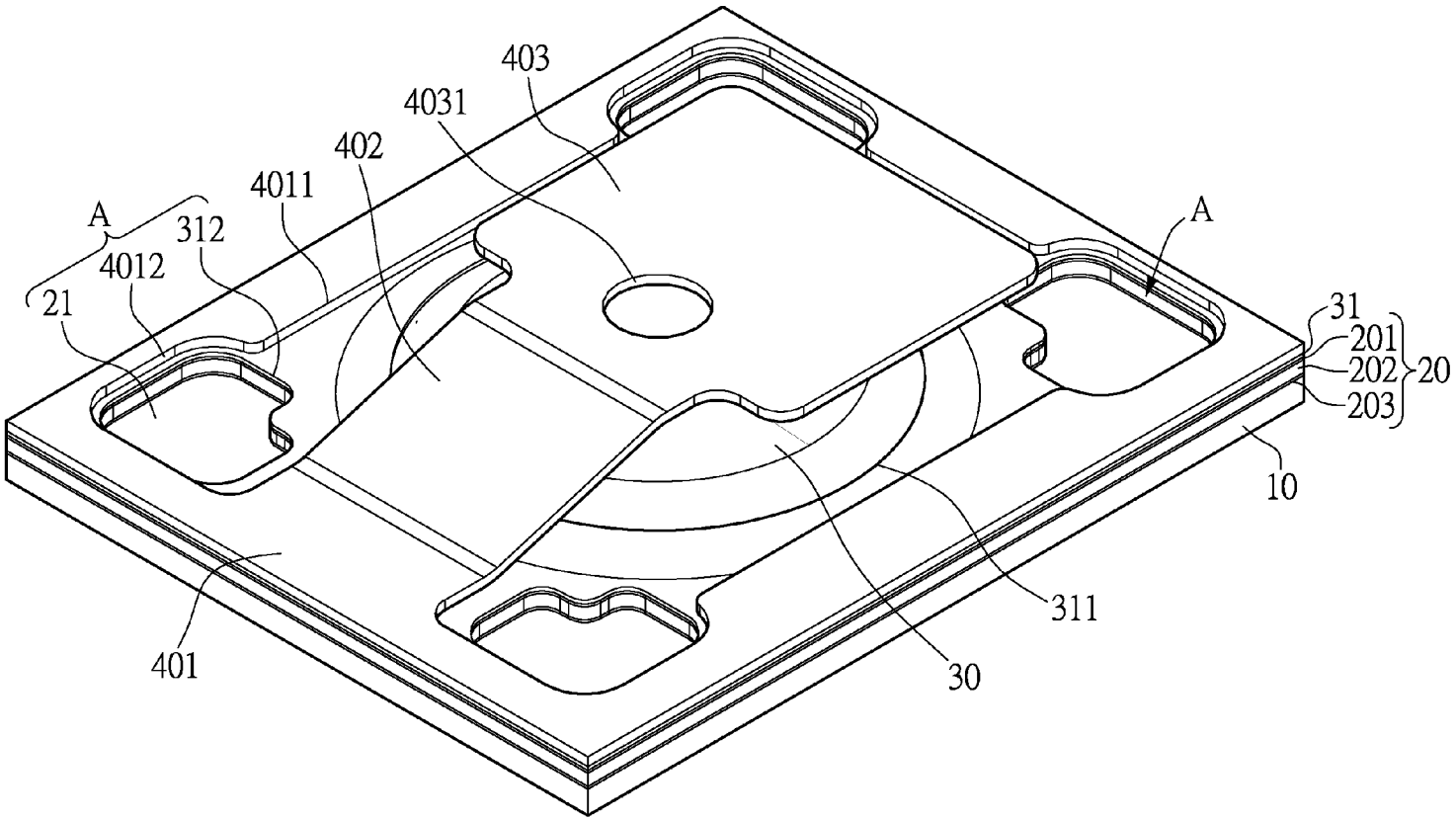
FIG. 3 is a diagram showing a supporting plate of a thin push button structure in accordance with a first embodiment of the instant disclosure.
Figure 4:
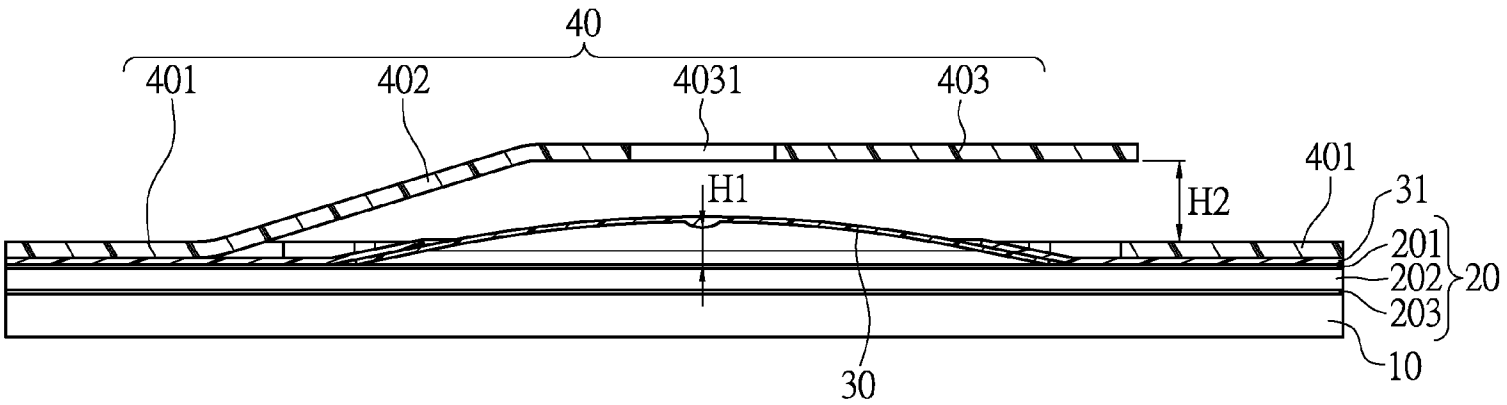
FIG. 4 is a side view showing a supporting plate of a thin push button structure in accordance with a first embodiment of the instant disclosure.

As shown in FIGS. 1, 3 and 4, the supporting plate 40 is disposed on top of the alignment plate 31. The supporting plate 40 includes a seat 401. The seat 401 is formed with a window 4011 at the central region, such that the seat 401 resembles a frame. An extending portion 402 extends from one side of the seat 401, and a contacting portion 403 extends from the free end of the extending portion 402. The contacting portion 403 and the seat 401 are at different levels. That is to say, a height difference H2 is generated between the contacting portion 403 and the seat 401. The contacting portion 403 is formed with a stem hole 4031 which is positioned to the apex of the dome-shaped elastic element 30. In addition, the corner of the window 4011 is shaped to conformingly receive the posts 52. The specifically configured corners are designated as second post holes 4012. The second posts holes 4012 are aligned with the first post holes 312 of the alignment plate 31 and the cavities 21 of the circuit board 20. Accordingly, the cavities 21 of the circuit board 20, the first post holes 312 of the alignment plate 31 and the second post holes 4012 of the supporting plate 40 collectively define a compartment A which provides a room when the posts 52 sink.

Figure 5:
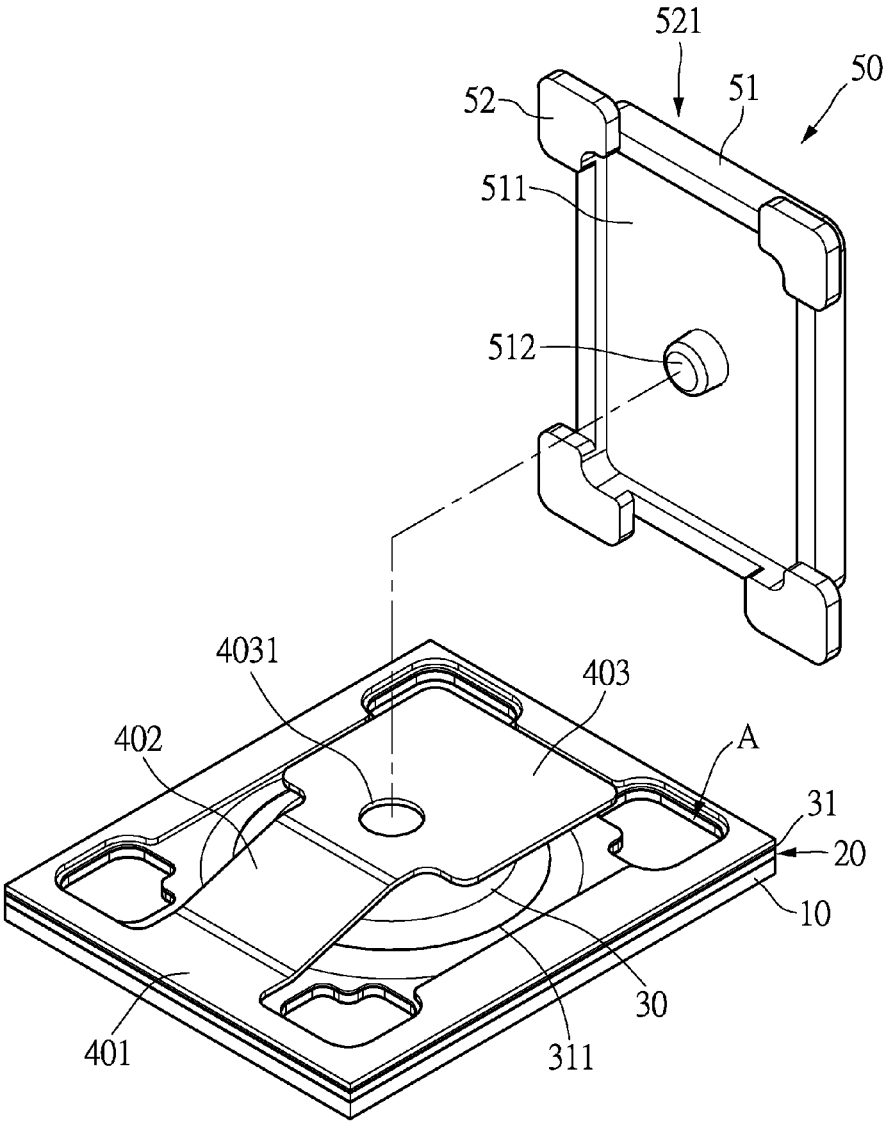
FIG. 5 is a diagram showing a key top of a thin push button structure in accordance with a first embodiment of the instant disclosure.
Figure 6:
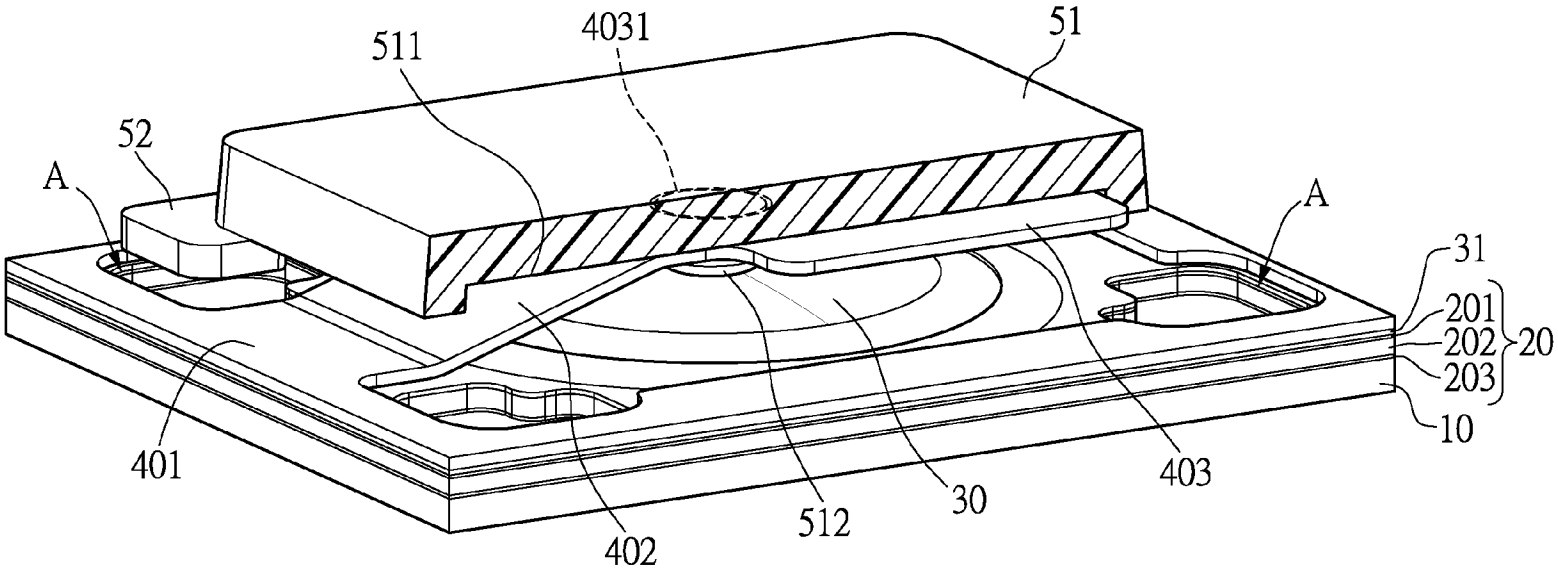
FIG. 6 is another diagram showing a key top of a thin push button structure in accordance with a first embodiment of the instant disclosure.

As shown in FIGS. 5 and 6, the key top 50 has the main body 51 and the plurality of posts 52. The main body 51 defines a receiving space 511 and has a stem 512 projecting from the main body 51 toward the receiving space 511. The posts 52 are arranged at the peripheral region of the main body 51 and stretching beyond the boarder of the main body 51. The key top 51 caps the supporting plate 40 and is supported thereby. More specifically, the supporting plate 40 is received by the receiving space 511, and the back of the key top 51 is flushed against the contacting portion 403 of the supporting plate 40. The stem 512 of the main body 51 goes through the stem hole 4031 of the contacting portion 403, such that the key top 50 is supporting by the contacting portion 403 of the supporting plate 40. More specifically, the key top 50 is suspended without contacting the other elements. Each of the posts 52 is suspended above the compartment A defined by the second post hole 4012 of the supporting plate, the first post hole 312 of the alignment plate 31 and the cavity 21 of the circuit board 20. When the key top 50 is pressed, the posts 52 shift linearly within the compartment A.

In practice, the contacting portion 403 of the supporting plate 40 may be connected to the back face of the main body 51 by glue, attachment, solder or the like. The posts 52 protrude from the back face of the main body 51 toward the receiving space 511. However, the posts 52 stretch beyond the boarder of the main body 51. Each two immediately adjacent posts 52 create a gap 521 which accommodates the extending portion 402 of the supporting plate 40. In other words, when the supporting plate 40 and the key top 50 are assembled, the contacting portion 403 is under the back face of the key top 50, while the extending portion 402 is positioned in the gap 521 which is in between two immediately adjacent posts 52. The thickness of the posts 52 contributes to the height of the gap 521, such that the extending portion 402 does not bang on the main body 51 when the key top 50 is pressed.

As shown in FIGS. 1, 7 and 8, the frame 60 is formed with a through opening 601 passing through the frame 60 and a plurality of alignment grooves 61 disposed on the periphery of the through opening 601. The frame 60 sleeves the key top 50 and rests on the supporting plate 40. The through opening 601 is slightly larger than the main body 51, such that the main body 51 projects out of the through opening 601 and is exposed thereon. The alignment grooves 61 are configured to fit the contour of the posts 52 and reject the posts 52 from escaping through the through opening 601. As a result, the key top 50 is confined by the frame 60. In other words, as shown in FIG. 8, after the frame 60 sleeves the key top 50, the posts 52 cannot escape the compartment A because the alignment grooves 61 of the frame 60 block the exit. After the key top 50 is pressed and shifts toward the circuit board 20, the key top 50 returns to its original position by the force provided from the elastic element 30, yet the frame 60 stops the key top 50 from ejecting further away of the entire assembly. The complete thin push button structure Z is shown in FIG. 9.

Second Embodiment

Figure 10:
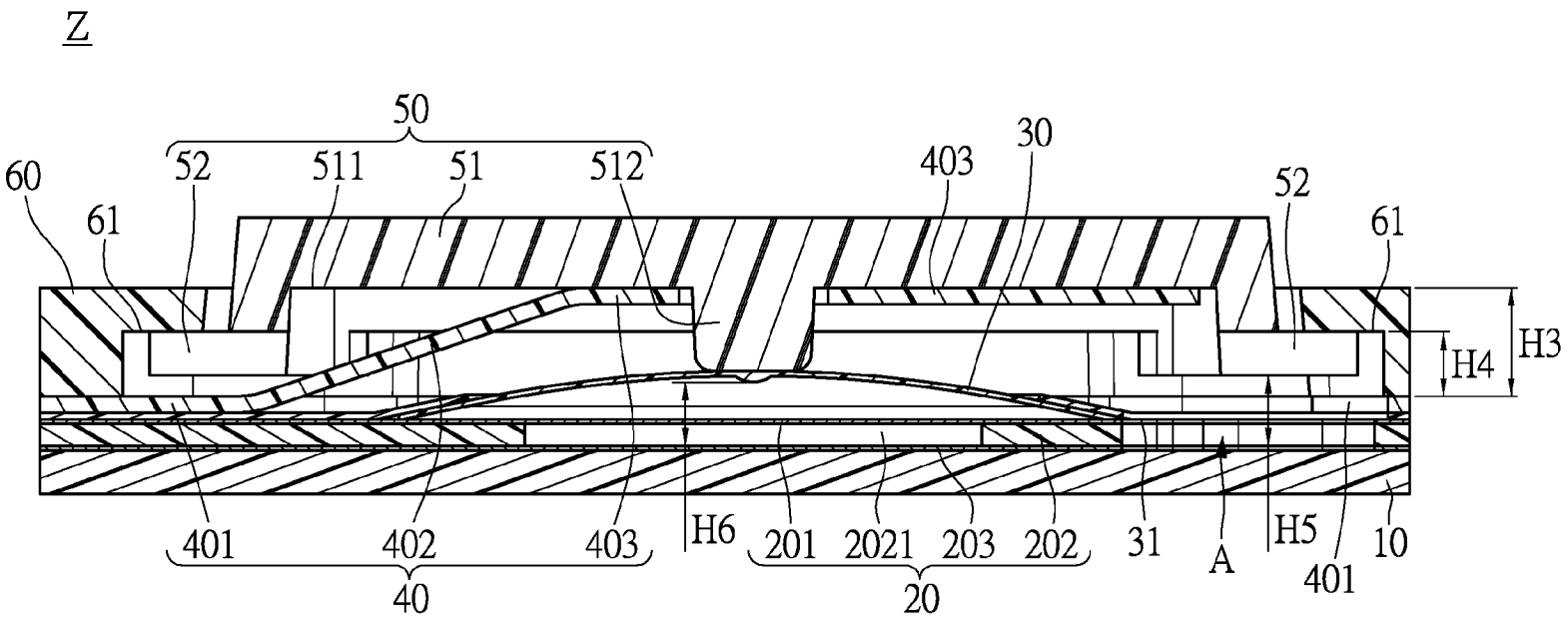
FIG. 10 is a diagram showing a thin push button structure before a key top thereof is pressed in accordance with a second embodiment of the instant disclosure.
Figure 11:
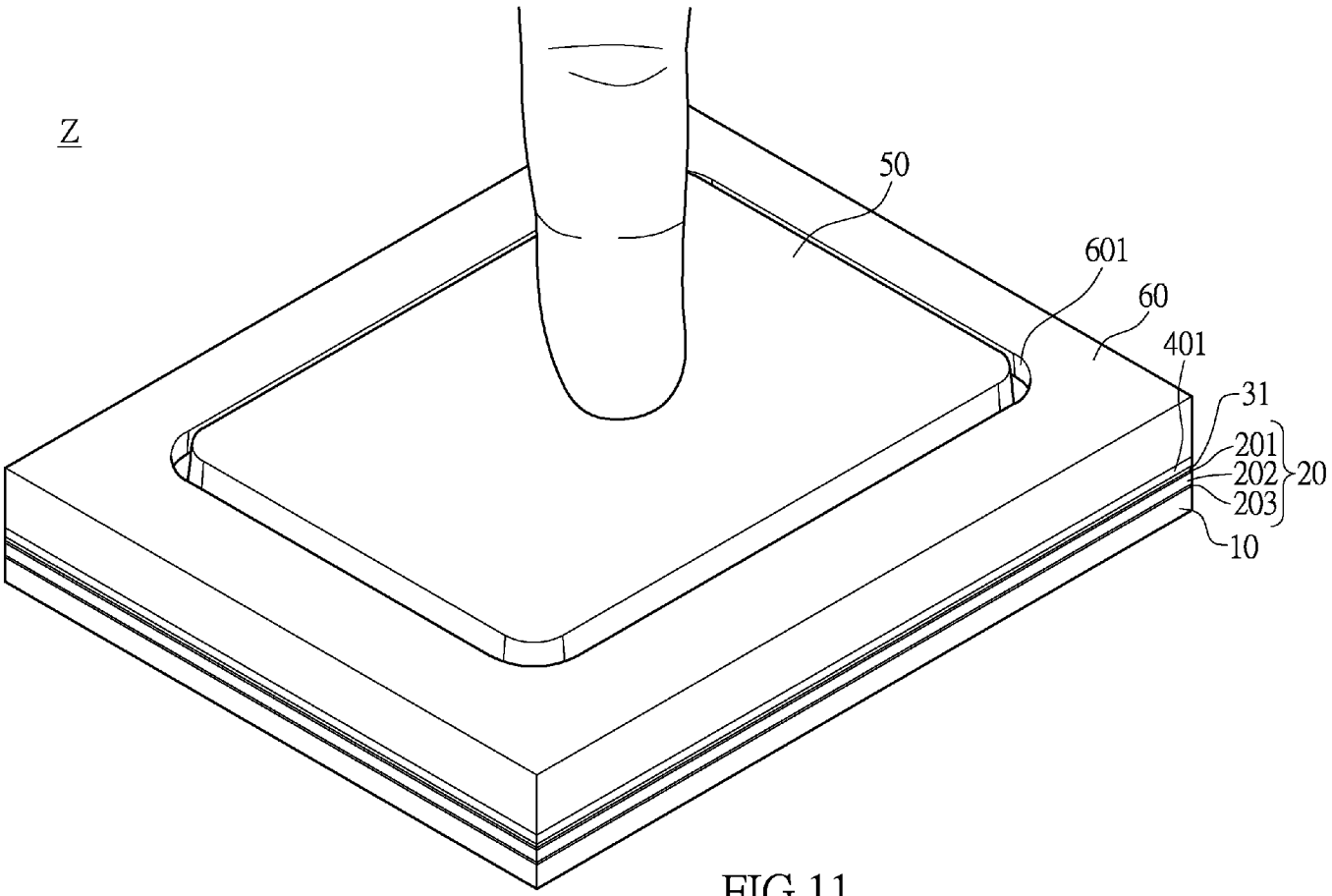
FIG. 11 is a diagram showing a thin push button structure after a key top thereof is pressed at a central region in accordance with a second embodiment of the instant disclosure.
Figure 12:
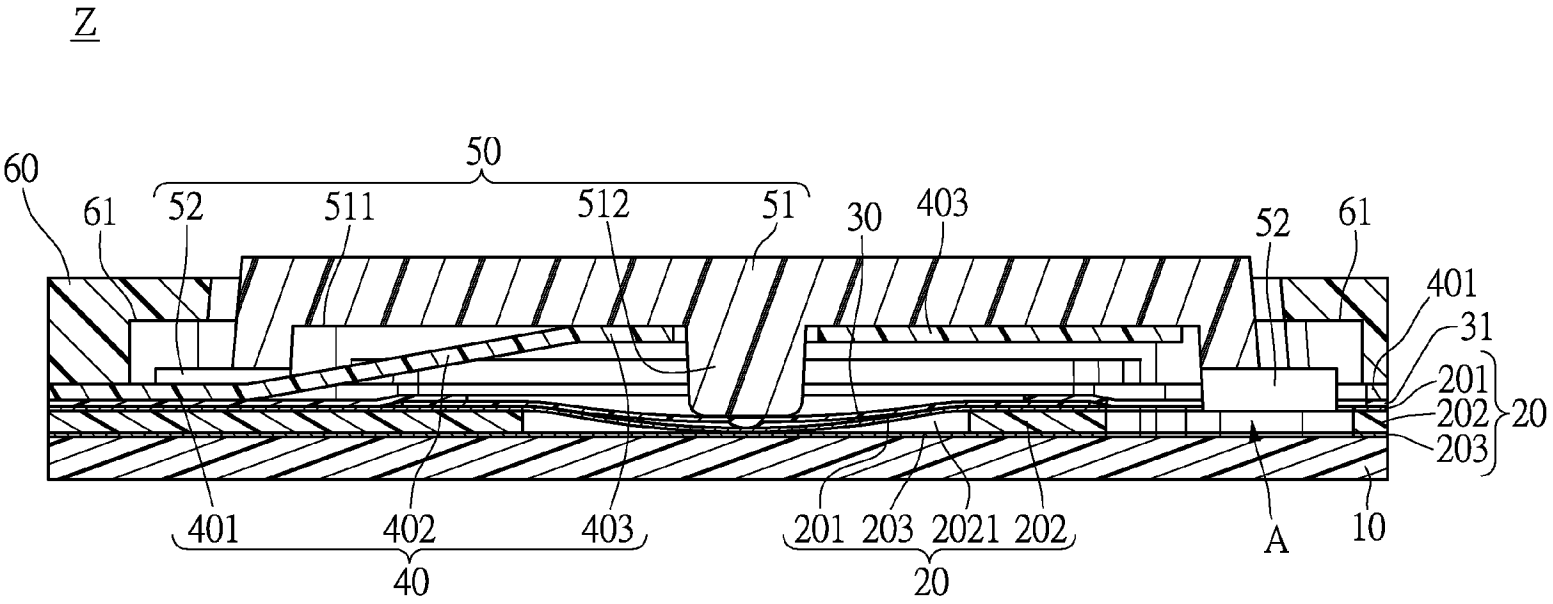
FIG. 12 is a cross-sectional view showing a thin push button structure after a key top thereof is pressed at a central region in accordance with a second embodiment of the instant disclosure.
Figure 13:
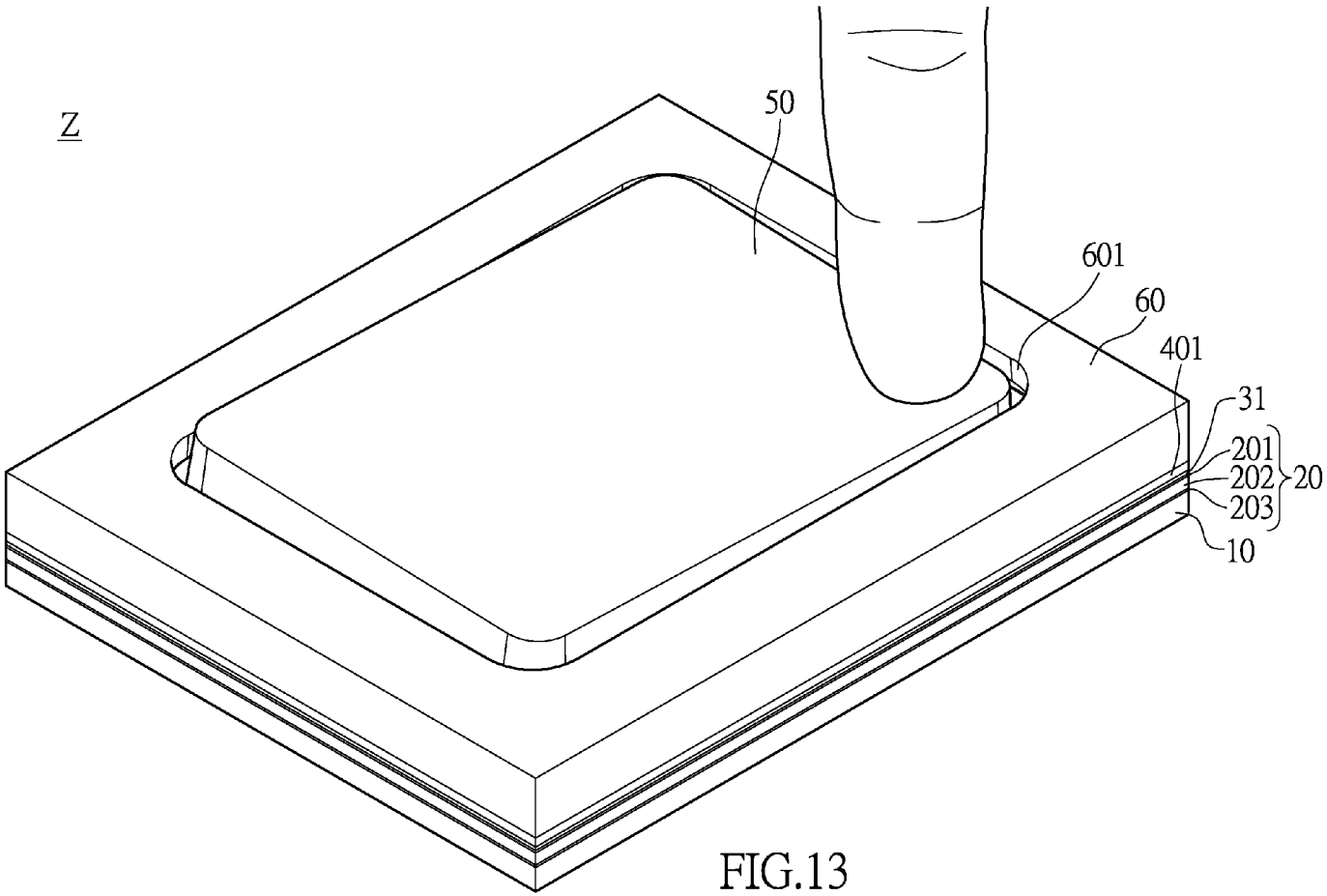
FIG. 13 is a diagram showing a thin push button structure after a key top thereof is pressed at a peripheral region in accordance with a third embodiment of the instant disclosure.
Figure 14:
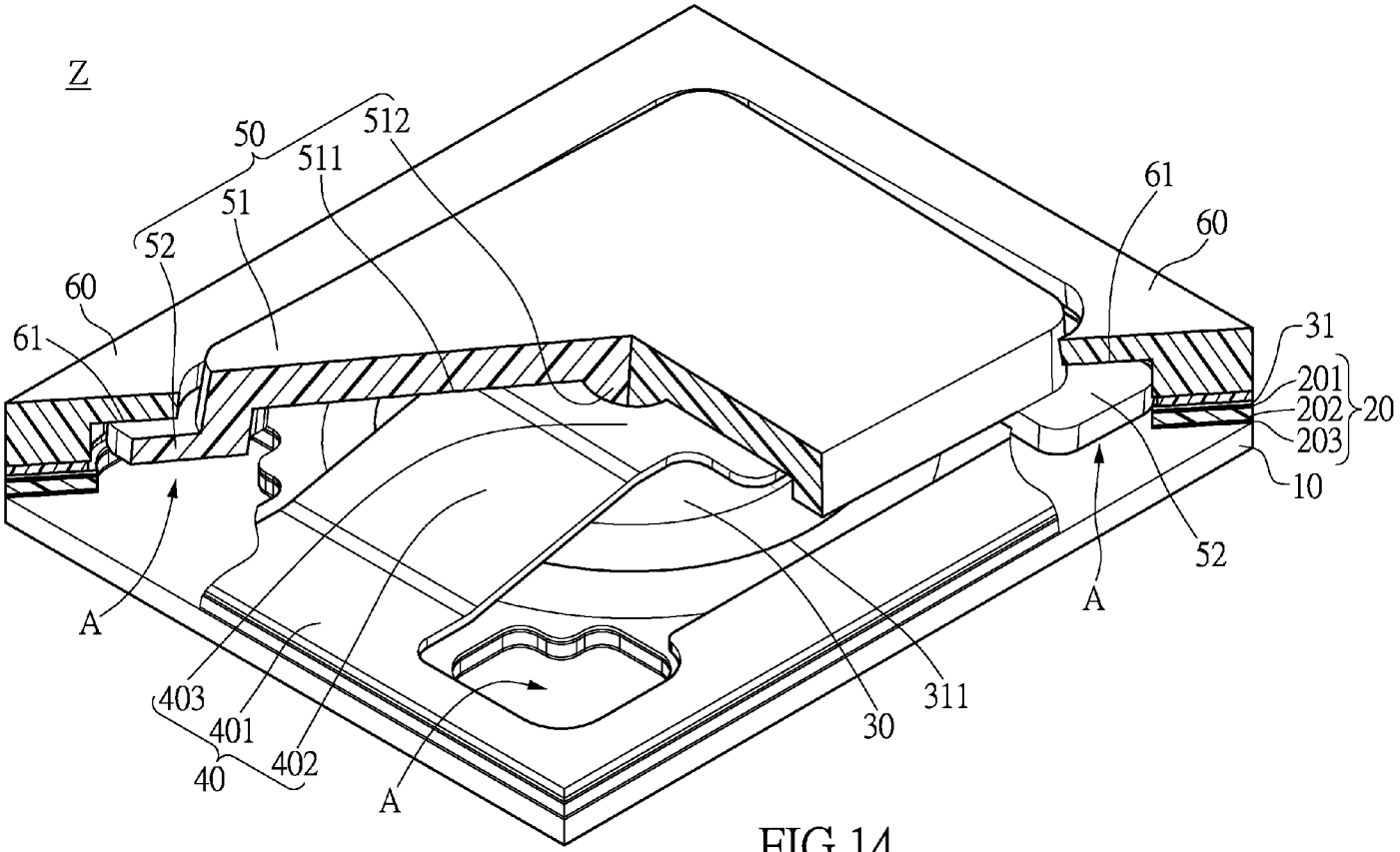
FIG. 14 is a cross-sectional view showing a thin push button structure after a key top thereof is pressed at a peripheral region in accordance with a third embodiment of the instant disclosure.
Figure 15:
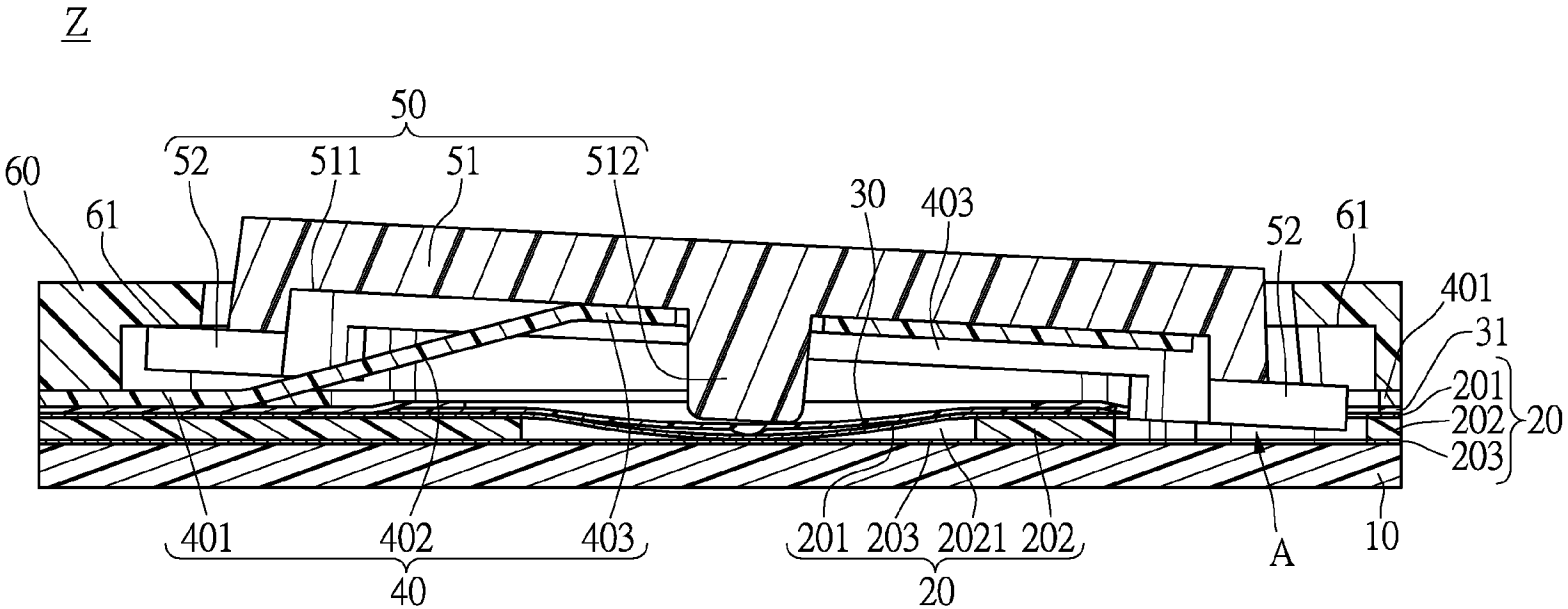
FIG. 15 is another cross-sectional view showing a thin push button structure after a key top thereof is pressed at a peripheral region in accordance with a third embodiment of the instant disclosure.
Figure 16:
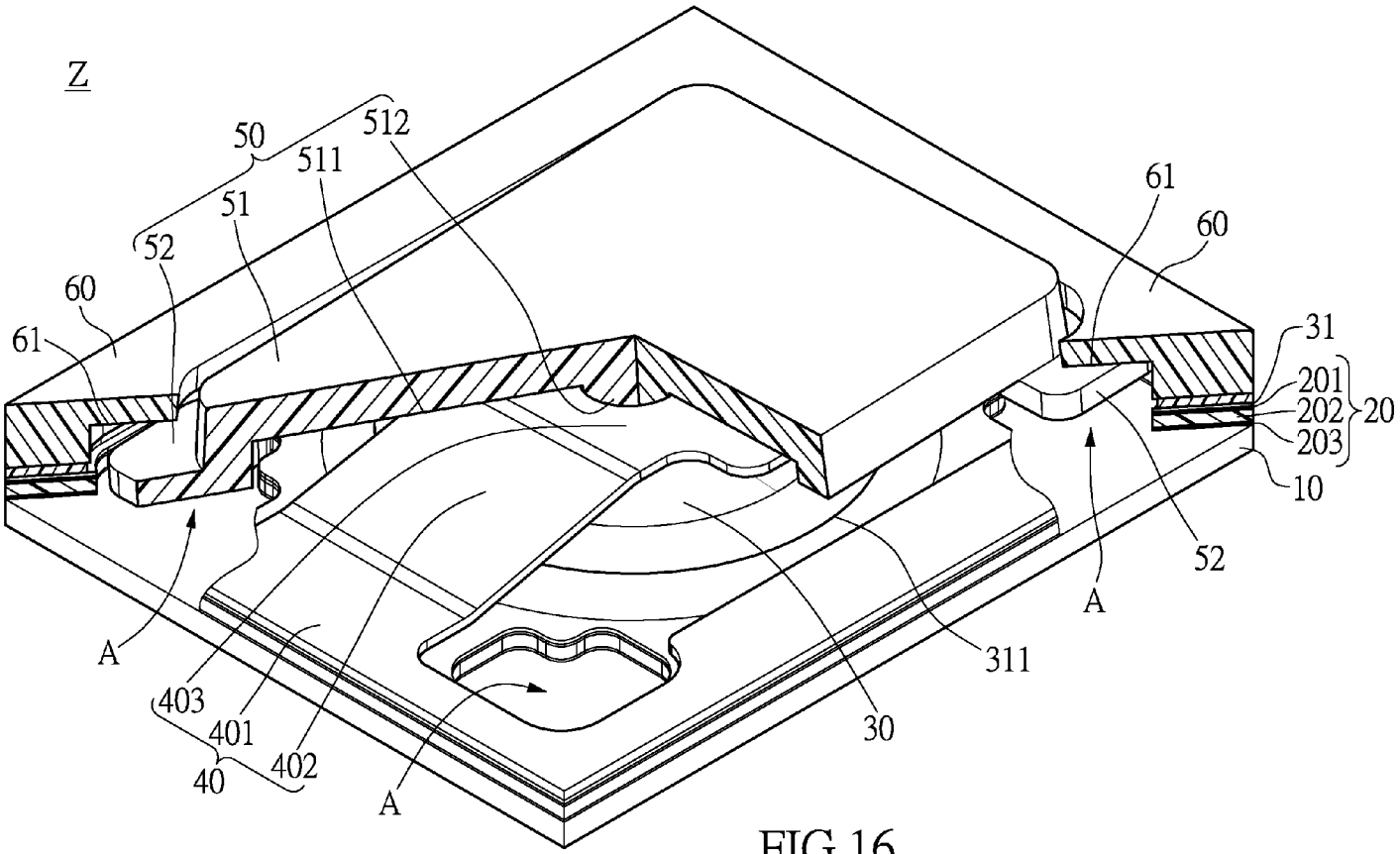
FIG. 16 is a diagram showing a thin push button structure after a key top thereof is pressed at a peripheral region in accordance with a third embodiment of the instant disclosure.

Please refer to FIGS. 10 to 12, which show the movement when a user presses the central region of the thin push button structure Z. FIG. 10 shows a cross-sectional view before the key top 50 is pressed. In the instant embodiment, the circuit board 20 has three layers including the top layer, a first conductive layer 201, a spacer 202 and the last layer, a second conductive layer 203. The first and second conductive layers 201, 203 have opposite electrode polarities. The spacer 202 is formed with a conduction hole 2021 at its central region. The dome of the elastic element 30 is positioned to the conduction hole 2021 of the spacer 202, and the stem 512 of the main body 51 aims at the dome of the elastic element 30. After the main body 51 covers the contacting portion 403 of the supporting plate 40, the stem 512 of the main body 51 contacts the dome apex of the elastic element 30.

As shown in FIG. 10, the distance H3 from the contacting portion 403 to the seat 401 is longer than a distance H4 from the frame 60 to the seat 401, such that the posts 52 are conformingly received by the grooves 61 of the frame 60. In addition, a distance H5 from the post 52 to the bottom of the compartment A is longer than a distance H6 from the stem 512 tip (i.e., the dome apex of the elastic element 30) to the second conductive layer 203 of the circuit board 20. As shown in FIGS. 11 and 12, when the main body 51 is pressed at the central region, the key top 50 shifts linearly, and the stem 512 abuts the elastic element 30, so as to cause elastic element 30 deformation. The elastic element 30 shows dimple and further contacts the first conductive layer 201 of the circuit board 20. As a result, the first and second conductive layers 201, 203 are electrically conducted to generate corresponding signals. It should also be noticed that as the key top 50 is pressed, the posts 52 move toward the circuit board 20 within the compartment A. That is to say, the posts 52 are mobile within the compartment A whenever the key top 50 is under pressure.

In another embodiment, the circuit board 20 may have double layers including the first conductive layer 201 and the second conductive layer 203. The first and second conductive layers 201, 203 are not electrically conducted. The first conductive layer 201 is formed with a hole corresponding to the stem 512 (i.e., the dome of the elastic element 30) for revealing the second conductive layer 20. The outer face of the first conductive layer 201 and the exposed second conductive layer 203 have opposite electrode polarities respectively. The elastic element 30 is disposed on the electrode of the first conductive layer 201.

Third Embodiment

FIGS. 13 to 16 show the movement when the key top 50 is pressed at the peripheral region. When a user presses a corner of the key top 50, the post 52 of the opposite corner (for example, the diagonal corner) is brought up and abuts the alignment groove 61 of the frame 60. As a result, the post 52, which abuts the alignment groove 61, becomes a fulcrum. The key top 50 pivots by taking the vary post 52 as a fulcrum. Then the tilted key top 50 abuts the elastic element 30 through the stem 512. Subsequently the first and second conductive layers 201, 203 of the circuit board 20 are electrically conducted, and the signal is generated.

Fourth Embodiment

Figure 17:
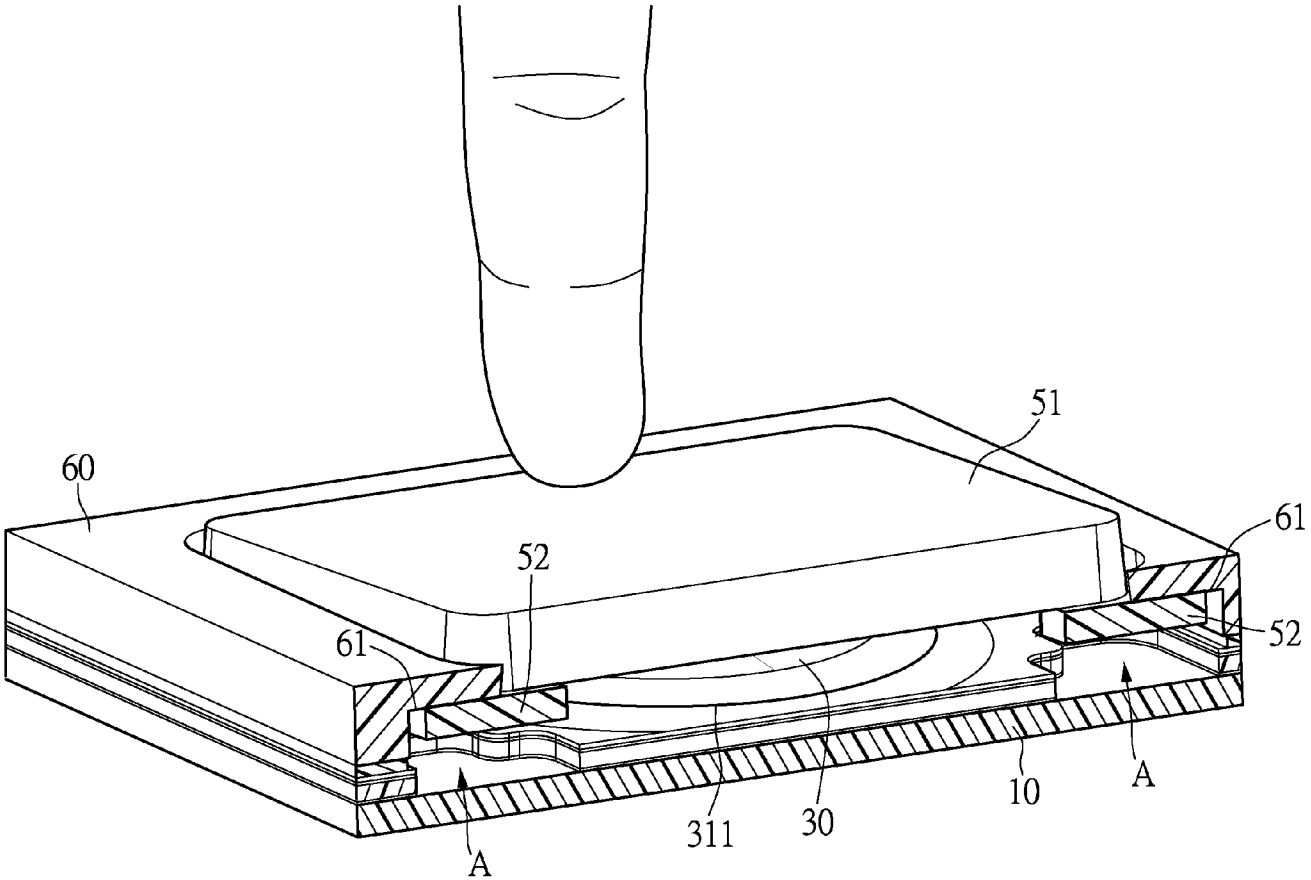
FIG. 17 is a diagram showing a thin push button structure after a key top thereof is pressed at a side portion in accordance with a fourth embodiment of the instant disclosure.

FIG. 17 shows the movement when one side of the key top 50 is pressed. When one side of the key top 50 is pressed, the two corresponding posts 52 shift toward the circuit board 20, while the opposite two posts 52 abut the alignment groove 61 of the frame 60. These two posts 52 act as the fulcrum for the key top 50, and therefore the key top 50 pivots and tilts. Consequently, the stem 512 pivots and abuts the elastic element 30, and the first and second conductive layers 201, 203 are electrically conducted so as to generate the signal.

Fifth Embodiment

Figure 18:
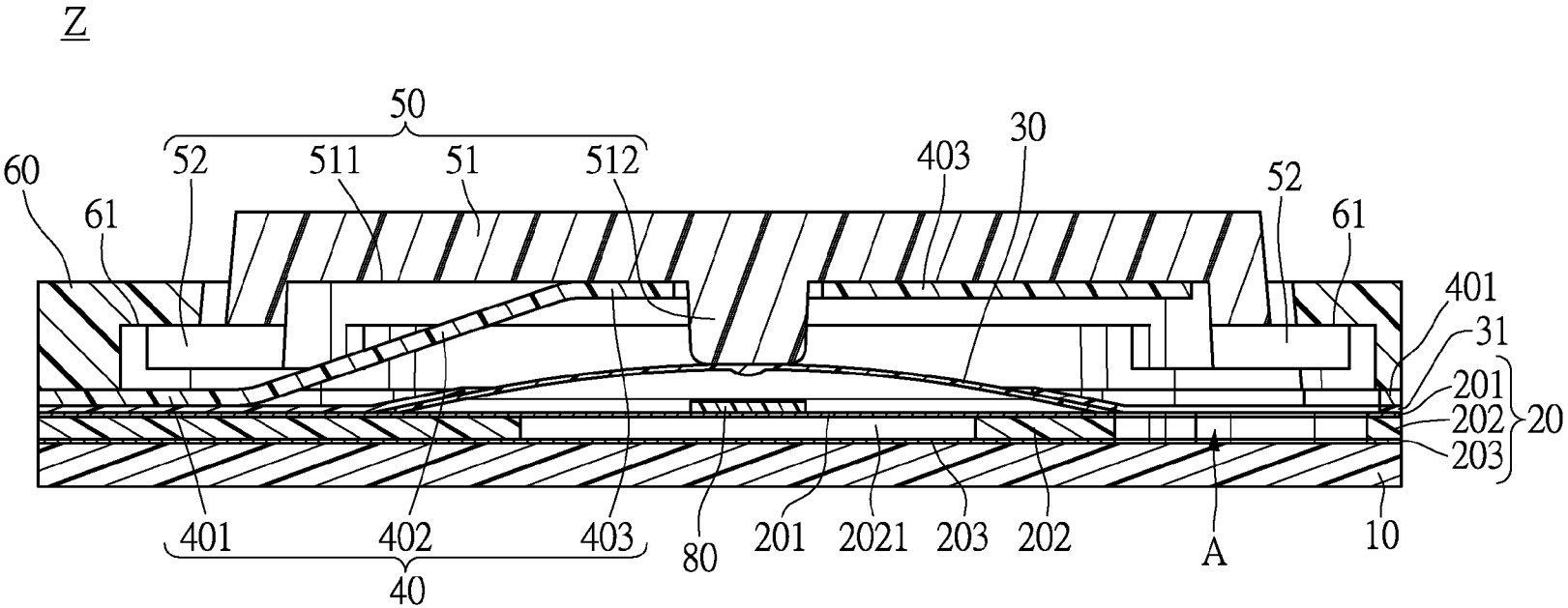
FIG. 18 is a cross-sectional view of a thin push button structure in accordance with a fifth embodiment of the instant disclosure.

FIG. 18 shows a fifth embodiment of the thin push button structure Z having increased sensitivity in response to peripheral pressure. The thin button structure Z includes a main board 10, a circuit board 20, an elastic element 30, an alignment plate 31, a supporting plate 40, a key top 50 and a frame 60. The difference between the fifth embodiment and the abovementioned embodiments arises from a supplemental element 80. The supplemental element 80 is disposed between the elastic element 30 and the first conductive layer 201. More specifically, the supplemental element 80 is positioned underneath where the stem 512 of the key top 50 sinks. When the elastic element 30 deforms, the supplemental element 80 is pressed and abuts the first conductive layer 201, such that the first and second conductive layers 201, 203 are electrically conducted. For example, the supplemental element 80 may be shaped as a cylinder, and the diameter is smaller than that of the elastic element 30 and the conduction hole 2021. The thickness of the supplemental element 80 is almost equivalent to the distance between the first and second conductive layers 201, 203. In another embodiment, the supplemental element 80 may be disposed between the second conductive layer 203 of the circuit board 20 and the main board 10.

Sixth Embodiment

Figure 19:
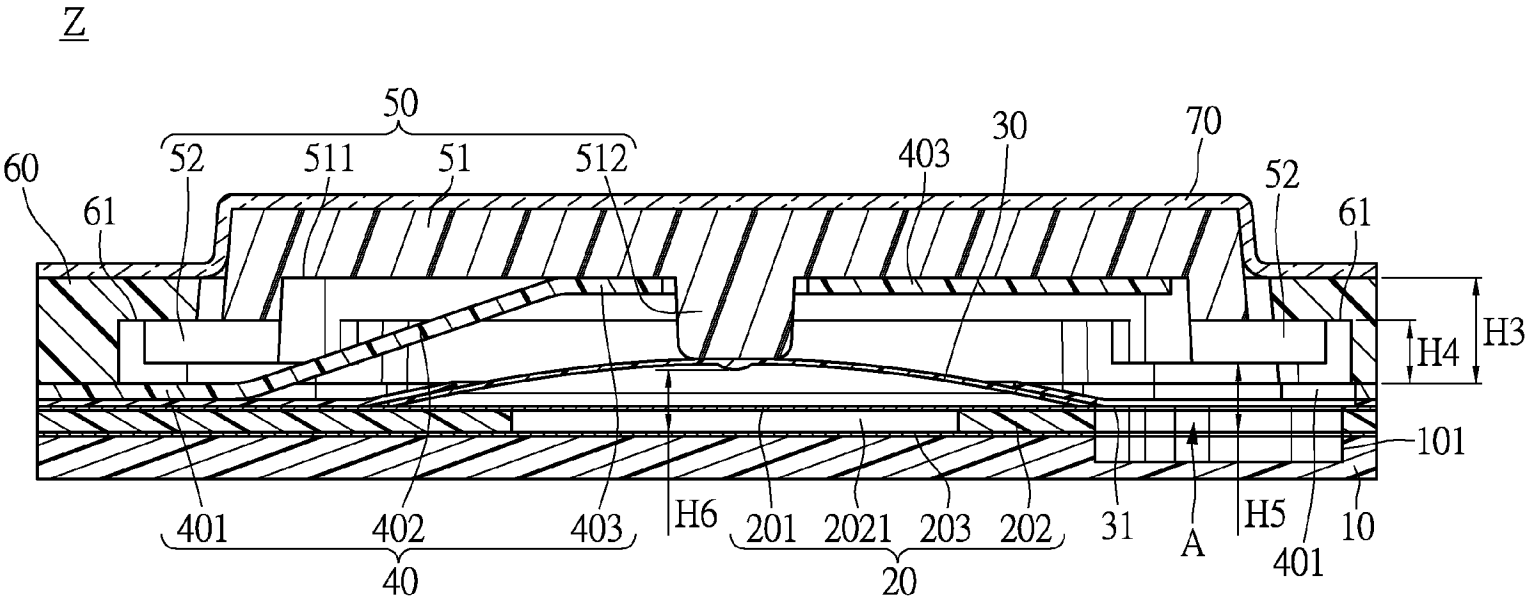
FIG. 19 is a cross-sectional view of a thin push button structure in accordance with a sixth embodiment of the instant disclosure.

FIG. 19 shows the thin push button structure of a sixth embodiment in accordance with the instant disclosure. The thin push button structure Z includes a main board 10, a circuit board 20, an elastic element 30, a supporting plate 40, a key top 50, a frame 60 and a waterproof element 70. The difference between the sixth embodiment and the abovementioned ones lies on the waterproof element 70. The waterproof element 70 covers the key top 50 and the frame 60 to prevent moisture or dust from entering the thin push button structure Z through the gap between the main body 51 and the frame 60. Moisture or dust may lead to circuit board 20 malfunctions. In practice, the waterproof element 70 is shaped according to the contour of the main body 51 and the frame 60, such that the exposed surface is completely covered. In addition, the main board 10 is formed with a groove 101 positioned toward the cavity 21 of the circuit board 20. Therefore, even if the overall collective thickness of the main board 10, circuit board 20, supporting plate 40, key top 50 and the frame 60 is reduced, the posts 52 of the key top 50 can still have enough room to go downwardly. It should be noticed that the waterproof element 70 may be included without the presence of the groove 101 of the main board 10, and vise versa. In the sixth embodiment, the waterproof element 70 and the groove 101 are both included, yet the instant disclosure is not limited thereto.

In short, the supporting plate includes the extending portion which slantingly extends to connect the contacting portion and the seat. The supporting plate holds the key top and aligns the stem of the key top in place. After the key top is pressed, the supporting plate provides a return force, such that the key top can flip back to its original position. In this regard, the key top supporting and alignment can be achieved with minimized thickness.

In addition, the key top has posts protruding outwardly from the main body. When the key top is not pressed at the central region, the post, which is closest to the pressed region, become a fulcrum, and the key top pivots accordingly. Subsequently, the key top tilts and abuts the elastic element. As a result, the first and second conductive layers are conducted to generate a corresponding signal. In this regard, no matter where the key top is pressed, the signal can be generated faithfully.

Furthermore, in one embodiment of the instant disclosure, the supplemental element disposed between the first and second conductive layers ensures the conduction between the first and second conductive layers and the following signal generation when the pressure does not come from the central region.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. A thin push button structure comprising:

a main board;

a circuit board disposed on the main board, wherein the circuit board is formed with a plurality of cavities;

a supporting plate including a seat, an extending portion and a contacting portion, wherein the seat is formed with a window at the central region, the seat and the contacting portion are at different levels connected by the extending portion, the extending portion extends from one side of the seat and meets one side of the contacting portion;

an elastic element disposed on the circuit board and underneath the contacting portion of the supporting plate;

a key top including a main body and a plurality of posts, wherein the key top defines a receiving space and the posts extend from the main body; and a frame including a through opening passing through the frame and a plurality of alignment grooves at the periphery of the opening, wherein the frame sleeves the key top, the posts are received by the alignment grooves;

wherein the key top caps the contacting portion of the supporting plate and is supported thereby, the key top is movable within a compartment defined by the alignment grooves of the frame and the cavities of the circuit board.

2. The thin push button structure according to claim 1, wherein the key top includes four protruded posts, the four posts are conformingly received by the alignment grooves, and the circuit board has four corresponding cavities.

3. The thin push button structure according to claim 1, wherein the key top has a stem projecting from a back of the main body toward the receiving space, the contacting portion is formed with a stem hole for receiving the stem.

4. The thin push button structure according to claim 1 further comprising a waterproof element covering the surface of the frame and the key top.

5. The thin push button structure according to claim 1 further comprising an alignment plate disposed on the circuit board, wherein the alignment plate includes a through hole, the elastic element is disposed on the alignment plate, a central region of the elastic element resembles a dome corresponding to the position of the through hole, and the dome creates a distance between the elastic element and the circuit board.

6. The thin push button structure according to claim 1 further comprising a pushing supplement disposed between the elastic element and the circuit board or the circuit board and the main board.

7. The thin push button structure according to claim 6, wherein the circuit board includes a first conductive layer, a second conductive layer and a spacer, the spacer is sandwiched between the first and second conductive layers, the spacer is formed with a conduction hole having a diameter larger than the pushing supplement and smaller than the elastic element.

8. The thin push button structure according to claim 6, wherein the key top has a stem projecting from a back of the key top toward the receiving space, when the key top is pressed at a peripheral region, the stem abuts the elastic element, and the elastic element abuts the pushing supplement then the circuit board.

9. The thin push button structure according to claim 1, wherein the cavities of the circuit board go through the circuit board, and the main board is formed with a depression corresponding to the position of the cavities.

10. The thin push button structure according to claim 1, wherein the width of the extending portion fits into a gap created between any two immediately adjacent posts of the key top.

* * * * *